US006431985B1

(12) United States Patent
Kim

(10) Patent No.: US 6,431,985 B1
(45) Date of Patent: Aug. 13, 2002

(54) FAIRNESS EVALUATION SYSTEM ABOUT JUDGMENT OF REFEREES AND MANAGEMENT OF COACHING STAFFS IN A SPORTS GAME VIA INTERNET

(76) Inventor: Jae-Hwak Kim, 513-1, Geonsan-ri, Jangheung-eub, Jangheung-gun, Jeonranam-do (KR)

( * ) Notice: Subject to any disclaimer, the term of this patent is extended or adjusted under 35 U.S.C. 154(b) by 0 days.

(21) Appl. No.: 09/776,755

(22) Filed: Feb. 6, 2001

(30) Foreign Application Priority Data

Dec. 28, 2000 (KR) ..... 2000-84730

(51) Int. Cl.[7] ..... A63F 13/00

(52) U.S. Cl. ..... 463/42; 463/1; 707/9; 700/91

(58) Field of Search ..... 463/1, 42, 43; 707/14, 9

(56) References Cited

U.S. PATENT DOCUMENTS 5,823,879 A * 10/1998 Goldberg et al. ..... 463/42
5,846,132 A * 12/1998 Junkin ..... 463/42
5,950,172 A * 9/1999 Klingman ..... 705/26
6,015,345 A 1/2000 Kail
6,033,316 A 3/2000 Nixon
6,135,881 A 10/2000 Abbott et al.
6,171,199 B1 1/2001 Cohodas et al.
6,240,415 B1 * 5/2001 Blumberg ..... 705/17

* cited by examiner

*Primary Examiner*—Jessica Harrison
*Assistant Examiner*—John M Hotaling, II
(74) *Attorney, Agent, or Firm*—Burns, Doane, Swecker & Mathis, LLP

(57) ABSTRACT

An evaluation system for the fairness about the judgment of referees and the management of coaching staffs in a sports game via internet and providing data thereof is provided, in which the data of the judgments of referees who control games and managements of coaching staffs are provided, scenes which are doubtful of the fairness are stored in an additional database to be transmitted in real time when information is requested from each terminal, game management records of the referees and the coaching staffs are continuously monitored, evaluation result values about the fairness and pertinency of the records are stored as data.

5 Claims, 7 Drawing Sheets

FIG.3

| Classification | | Monitoring Subject and Evaluator Distribution | | | | | |
|---|---|---|---|---|---|---|---|
| | | Point | Referee(Chief Referee) | Referee(Subreferee) | | Coach A | Coach B |
| Total Point and Distribution Rate About Monitoring People | Certified Expert | 60% | 3 | 3 | 3 | 3 | 3 |
| | Registered Expert | 30% | 50 | 50 | 50 | 50 | 50 |
| | Common Internet User | 10% | 100 | 100 | 100 | 100 | 100 |
| | Total | 100% | | | | | |
| | | | | | | | |
| | Total Evaluation Rate | 100% | 50% | 10% | 10% | 15% | 15% |

FIG.4

DETAILS

| Game Operation | | | | | Communication With Subreferee | | | Dignity | | | | | | | | | | Total |
|---|---|---|---|---|---|---|---|---|---|---|---|---|---|---|---|---|---|---|
| Excellent | Good | Average | Loose | Very Loose | Harmony Between Referee | Operative Area of SureFeree and Recognition of Judgement | Player Substitute | Body Language | | Non-Game Reaction | | Pertinency to Bench Action | | Dealing Improper Action of Player | | Pertinency of Penalty | | |
| 10 | 7 | 5 | 3 | 1 | 2 | 2 | 1 | ○ | × | ○ | × | ○ | × | ○ | × | ○ | × | |
| | | | | | | | | 3 | 1 | 3 | 1 | 3 | 1 | 3 | 1 | 3 | 1 | |

| Pertinency of Judgement | | | | | | | | | | | | |
|---|---|---|---|---|---|---|---|---|---|---|---|---|
| Closeness of Judging Position | | | Pertinency of Judging Point | | | Correctness of Expression(Signal) | | | Correctness of Judgment | | | |
| Always | Generally | Seldom | Excellent | Average | Poor | Excellent | Average | Poor | Excellent | Average | 5 Point Penalty Per 1 Misjudgment | |
| 5 | 3 | 2 | 5 | 3 | 1 | 5 | 3 | 2 | 15 | 10 | ■ | |

| Major Foul Judgment | | | | | | | | | | | |
|---|---|---|---|---|---|---|---|---|---|---|---|
| Partial Judgment | | Pertinency of P.K Declaration | | Pertinency of Offside Declaration | | | Pertinency of Judgment in Main Area | | | | |
| Near Box | Breaking Game Operation | Yes | No | Excellent | Average | 5 Point Penalty Per 1 Misjudgment | Excellent | Good | Poor | Very Poor | |
| 0 | -5 | 10 | 0 | 10 | 7 | ■ | 10 | 7 | 3 | 1 | |

FIG.5

1. Teams :
2. Time :
3. Location :
4. Major Referee :

| Evaluating Element | | Distribution | Judging Element | Point | Total |
|---|---|---|---|---|---|
| Game Managing Ability(30) | Game Operation | 10 | Good | | |
| | | | Poor | | |
| | Communication of Subrefree | 2 | Harmony Between Referees | | |
| | | 2 | Operative Area of Sureferee and Recognition of Judgement | | |
| | | 1 | Harmonious Player Substitute | | |
| | Dignity | 3 | Pertinency of Penalty | | |
| | | 3 | Dealing Improper Action of Player | | |
| | | 3 | Reaction to Impertinent Bench Action | | |
| | | 3 | Non-Game Reaction | | |
| | | 3 | Body Language | | |
| Correctness(30) | Pertinency of Judgement | 5 | Closeness of Judging Position | | |
| | | 5 | Pertinency of Judging Point | | |
| | | 5 | Correctness of Expression(Signal) | | |
| | | 15 | Correctness of Judgement (5 Point Penalty Per 1 Misjudgement) | | |
| Partial Judgement and Misjudgement(40) | Major Foul Judgement and Partial Judgement | 10 | Partial Judgement | | |
| | | 10 | Pertinency of P.K Declaration | | |
| | | 10 | Pertinency of Offside Declaration | | |
| | | 10 | Pertinency of Judgement in Main Area | | |
| | | 10 Points are Added to Partial Judgment When A P.K Is Not Declared | | | |
| | | 100 | | | Signature |

FIG.7

Monitoring Korea to Japan Game

1. Teams : Korea to Japan
2. Time : December 20, 2000. 19:00
3. Location : Tokyo National Stadium of Japan
4. Major Referee : Singapore

| Evaluating Element | | Distribution | Judging Element | Point | Total |
|---|---|---|---|---|---|
| Game Managing Ability(30) | Game Operation | 10 | Good | 10 | 52Point (Reeducation Recommended) |
| | | | Poor | | |
| | Communication of Subrefree | 2 | Harmony Between Referees | 1 | |
| | | 2 | Operative Area of Sureferee and Recognition of Judgement | 1 | |
| | | 1 | Harmonious Player Substitute | 1 | |
| | Dignity | 3 | Pertinency of Penalty | 0 | |
| | | 3 | Dealing Improper Action of Player | 3 | |
| | | 3 | Reaction to Impertinent Bench Action | 3 | |
| | | 3 | Non-Game Reaction | 3 | |
| | | 3 | Body Language | 3 | |
| Correctness(30) | Pertinency of Judgement | 5 | Closeness of Judging Position | 2 | |
| | | 5 | Pertinency of Judging Point | 3 | |
| | | 5 | Correctness of Expression(Signal) | 2 | |
| | | 15 | Correctness of Judgement (5 Point Penalty Per 1 Misjudgement) | 5 | |
| Partial Judgement and Misjudgement(40) | Major Foul Judgement and Partial Judgement | 10 | Partial Judgement | 5 | |
| | | 10 | Pertinency of P.K Declaration | 0 | |
| | | 10 | Pertinency of Offside Declaration | 10 | |
| | | 10 | Pertinency of Judgement in Main Area | 0 | |
| | | 10 Points are Added to Partial Judgment When A P.K Is Not Declared | | 52 | |
| | | 100 | | | Signature |

FAIRNESS EVALUATION SYSTEM ABOUT JUDGMENT OF REFEREES AND MANAGEMENT OF COACHING STAFFS IN A SPORTS GAME VIA INTERNET

BACKGROUND OF THE INVENTION

1. Field of the Invention

Present invention relates to a fairness evaluation system about the judgment of referees and the management of coaching staffs in a sports game via internet, in which a sports game according to event is broadcasted via internet so that experts and internet users can objectively evaluate the pertinency and the fairness of referees and coaching staffs, and related data are stored in a database so that any sports related cheat such as a fabricated outcome can be prevented.

2. Description of the Related Art

Recently, the concept of the sports game has changed from a simple TV broadcasting into a participating one according to the rapid development of the internet, and the function of the TV broadcasting also has changed from a one way suppliance to TV viewers into an interactive one with them due to the remarkable development of information and communication technologies.

Therefore, all kinds of sports information wanted by users and various service function that the users can participate themselves for enjoyment as well are provided. A number of exciting worldwide sports sites that are taking place every moment can be experienced with a simple clicking.

Therefore, together with the remarkable development of the internet, desires about information of the sports, dissatisfactions about the one way appliance of game regulations in the game management and doubts about the fairness about the games are increasing, and desires to know about the fabricated outcome and other fair play related things are also increasing.

Also, in sports broadcastings using internet media, even if a terminal or a monitor can provide exciting and vivid feelings as real time transmission technologies of dynamic images have been gradually developed, there is no system that evaluates the erroneous management and the partial judgment through a real time monitoring of the game. The analysis is simply treated in the sports sections of newspapers after the game. Actually, the partial judgment or other things which are disputable of the fairness can be easily forgotten as time passes.

In every sports game, the referees or the coaching staffs who manage the game do not gain interests while all the attentions tend to be centered to players. So, the fairness and the pertinency of the referees' judgments and the coaching staffs' managements may not be properly evaluated.

Also, though there are misjudgments or partial judges, there are no records about the referees if they are not punished in a disciplinary committee by a strong protest such as an audience riot or an examination request from coaches so that the referees can appear in another game and make wrong judgments thereby causing blames from a number of people.

Therefore, though the audience and the TV viewers simply immerse themselves into the players, however the players are suffering again since they should try to read the mind of the coaching staffs and the referees while endeavoring to enhance the capability at the same time. Such a practice can be a hindrance against the development of the sports.

SUMMARY OF THE INVENTION

Present invention is proposed to solve the foregoing problems, and it is therefore an object of the invention to provide a system for evaluating the fairness about the judgment of referees and the management of coaching staffs in a sports game via internet and providing data thereof, in which the data of the judgments of referees who control games and managements of coaching staffs are provided, scenes which are doubtful of the fairness are stored in an additional database to be transmitted in real time when information is requested from each terminal, game management records of the referees and the coaching staffs are continuously monitored, evaluation result values about the fairness and pertinency of the records are stored as data, information is continuously provided by using an internet network system, and a consultation and/or fabricated outcome among the referees, the coaching staffs and players are monitored so that any sports related cheat can be eliminated and a more pleasant and cleaner fair play spirit can be obtained.

To obtain the foregoing object of the invention, it is provided a fairness evaluation system about the judgment of referees and the management of coaching staffs in a sports game via internet in a broadcasting system, comprising: a broadcasting media 200 having a broadcasting station server 210 for converting and transmitting data so that a live or recorded relay of a game situation through a broadcasting camera 220 from a game site can be watched through communication media such as the internet; a terminal 100 having a web browser for showing the images through the broadcasting media 200 on a monitor through the internet; a web server 300 for transmitting the sports game sent from the broadcasting media 200 to each of the terminal 100 and for managing and receiving various information; a game regulation database 400 connected to the web server 300 for storing each game regulation according to event as data; a referee/coaching staff database 500 for storing personal information and history of referees and coaching staffs involved in the game as data; a situational judgment standard database 600 for storing data or images of judgment in special or apparent referential situations from previous games; a fairness evaluation reference database 700 for storing fairness evaluating references about the referees and the coaching staffs of the game through the terminal 100; a search database 900 for providing real time information on the basis on true pictures and graphic data if internet users want to know applied regulations; and an advertisement database 800 for inserting advertisements during the game.

Preferably, the terminal has: a site terminal 110 of previously certified and registered experts for monitoring in the game site through the web server 300; a registered terminal 120 of experts registered in the web server 300 for evaluating the fairness of the relayed images on a monitor through a computer in a location besides the game site; and an unregistered terminal 130 of the common internet users connected with the web server 300 for evaluating the fairness.

Also, to obtain the foregoing object of the invention, it is provided a fairness evaluation method about the judgment of referees and the management of coaching staffs in a sports game via internet in a broadcasting system, comprising the steps of: connecting each of evaluators to a web server 300 of the internet and selecting a game according to event; if an ID and a PW of each of evaluators is entered, inspecting in the web server 300 if each of the evaluators is the certified expert or a registered expert who is previously set up in the web server or a common internet user and certifying the evaluators according to evaluation rank; receiving in the web server 300 evaluation points through an evaluation form previously given according to situation while broadcasting game images through broadcasting media including the internet; temporarily storing in the web server 300 the evaluation points and continuously accumulating until the game is over; and if the game is over, inspecting in the web server 300 if there is a violation against the evaluation standard of a fairness evaluation reference database 700, storing the evaluation points as data about pertinent person of the referee/coaching staff database 500, and then totaling the evaluation points for the mean values to transmit evaluation results to the evaluators and others connected to the web server.

Preferably, the step of receiving in the web server 300 evaluation points comprises the step of real time transmitting the evaluation points to the evaluators according to situation while temporarily storing in the web server 300 the evaluation points.

Furthermore, to obtain the foregoing object of the invention, it is provided a recording medium recording a computer-readable program in a broadcasting system for sports games via internet, the computer-readable program comprising the functions of: converting data so that a live or recorded relay of a game situation through a broadcasting camera 220 from a game site can be watched through communication media such as the internet; storing each game regulation according to event in a web server 300 connected to the internet as data; storing personal information and history of referees and coaching staffs involved in the game as data; storing data or images of judgment in special or apparent referential situations from previous games; storing fairness evaluating references about the referees and the coaching staffs of the game through the terminal 100; if internet users want to know applied regulations, providing real time information on the basis on true pictures and graphic data; and inserting advertisements during the game through the web server 300.

BRIEF DESCRIPTION OF THE DRAWINGS

FIG. 3 shows grades and distribution rates according to an embodiment of the invention;

FIG. 4 shows details of the fairness evaluation standard about a referee according to the embodiment of the invention;

FIG. 5 shows an example of a report sheet for the fairness evaluation of a soccer game according the embodiment of the invention;

FIG. 7 is an example of filling out the report sheet of FIG. 5 for the fairness evaluation of the soccer game according the embodiment of the invention.

DETAILED DESCRIPTION OF THE PREFERRED EMBODIMENT

Hereinafter, a fairness evaluation system about the judgment of referees and the management of coaching staffs in a sports game via internet of the invention will be described in detail in reference to the appended drawings.

Figure 1:
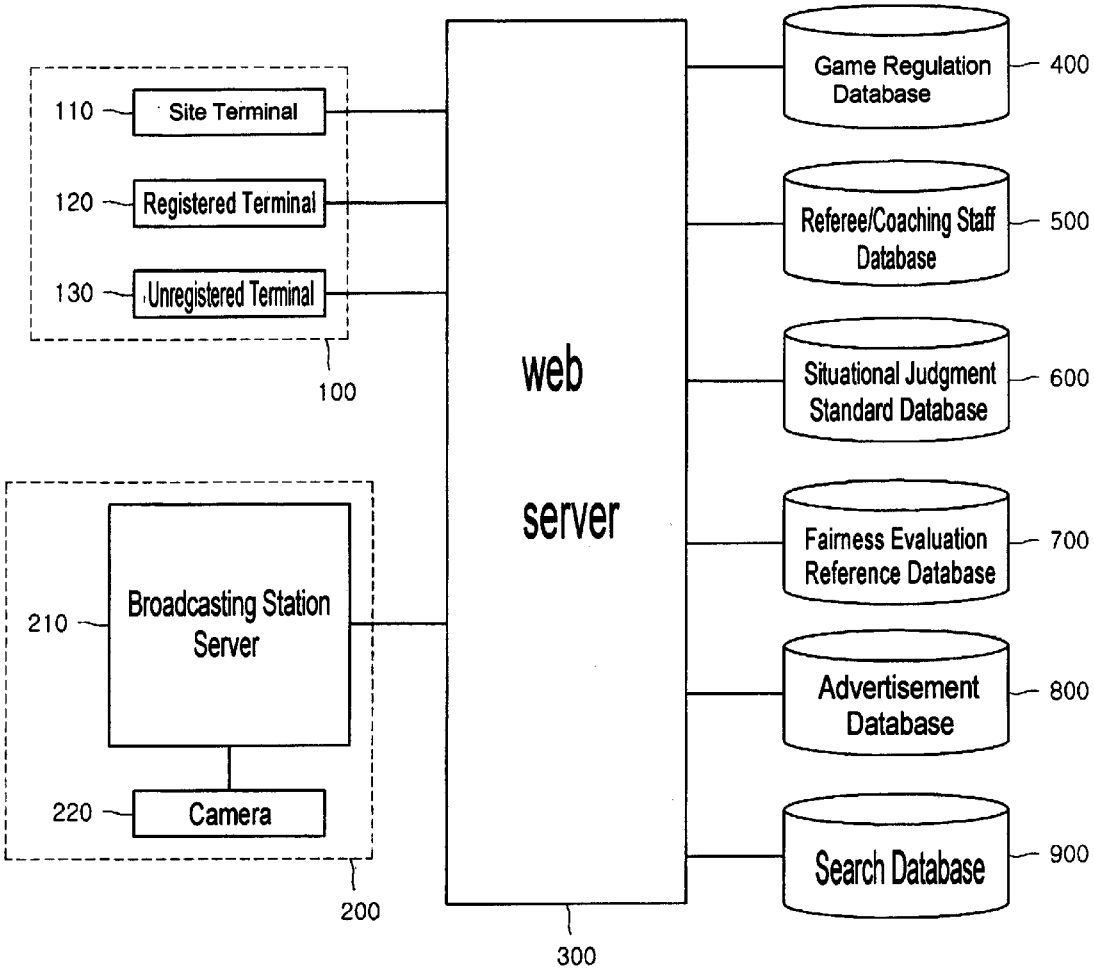
FIG. 1 is a schematic view for illustrating the structure of a fairness evaluation system about the judgment of referees and the management of coaching staffs in a sports game via internet according to the invention.

FIG. 1 is a schematic view for illustrating the structure of a fairness evaluation system about the judgment of referees and the management of coaching staffs in a sports game via internet according to the invention.

Referring to FIG. 1, the fairness evaluation system of the invention comprises a broadcasting media 200 having a broadcasting station server 210 for converting and transmitting data so that a live or recorded relay of a game situation through a broadcasting camera 220 from the game site can be watched through communication media such as the internet, a computer or a terminal 100 having a web browser so that the images through the broadcasting media 200 can be watched on a monitor through the internet, a web server 300 (hereinafter will be referred to as the web server of the invention) for transmitting the sports game sent from the broadcasting media 200 to each of the terminal 100 and for managing and receiving various information, a game regulation database 400 connected to the web server 300 for storing each game regulation according to event as data, a referee/coaching staff database 500 for storing personal information and history of referees and coaching staffs involved in the game as data, a situational judgment standard database 600 for storing data or images of judgment in special or apparent referential situations from previous games, a fairness evaluation reference database 700 for storing fairness evaluating references about the referees and coaching staffs of the game through the terminal 100, an advertisement database 800 for inserting advertisements during the game, and a search database 900 which can provide a real time information on the basis on true pictures and graphic data when internet users want to know applied regulations.

The computer 100 includes a site terminal 110 of experts who are previously certified and registered as expert to monitor in the game site through the web server 300 of the invention, a registered terminal 120 of experts registered in the web server 300 to evaluate the fairness of the relayed images on a monitor through a computer in a location besides the game site, and an unregistered terminal 130 of the common internet users to be connected with the web server 300 and evaluate the fairness.

Those evaluators of the fairness and pertinency about the referees and the coaching staffs composed as above define a certified expert group or the site terminal 110 which consists of excellent experts about each sports event, a registered expert group or the registered terminal 120 which consists of experts with at least a certain degree of knowledge, and the unregistered terminal 130 of the common internet users in order to evaluate the referees and the coaching staffs. When the evaluators enter points in the evaluation forms transmitted to their computers according to a predetermined evaluation standard and transmit the forms to the web server 300, the web server 300 totals each of the evaluations constituted with a predetermined rate to provide a situational evaluation point in real time and transmits the final evaluation points to the evaluators and the common internet users after the game is finished.

Also, the evaluation results are stored as information of the referees and the coaching staffs so that the fairness and the pertinency of the referees and the coaching staffs can be estimated through the objective evaluation.

Figure 2:
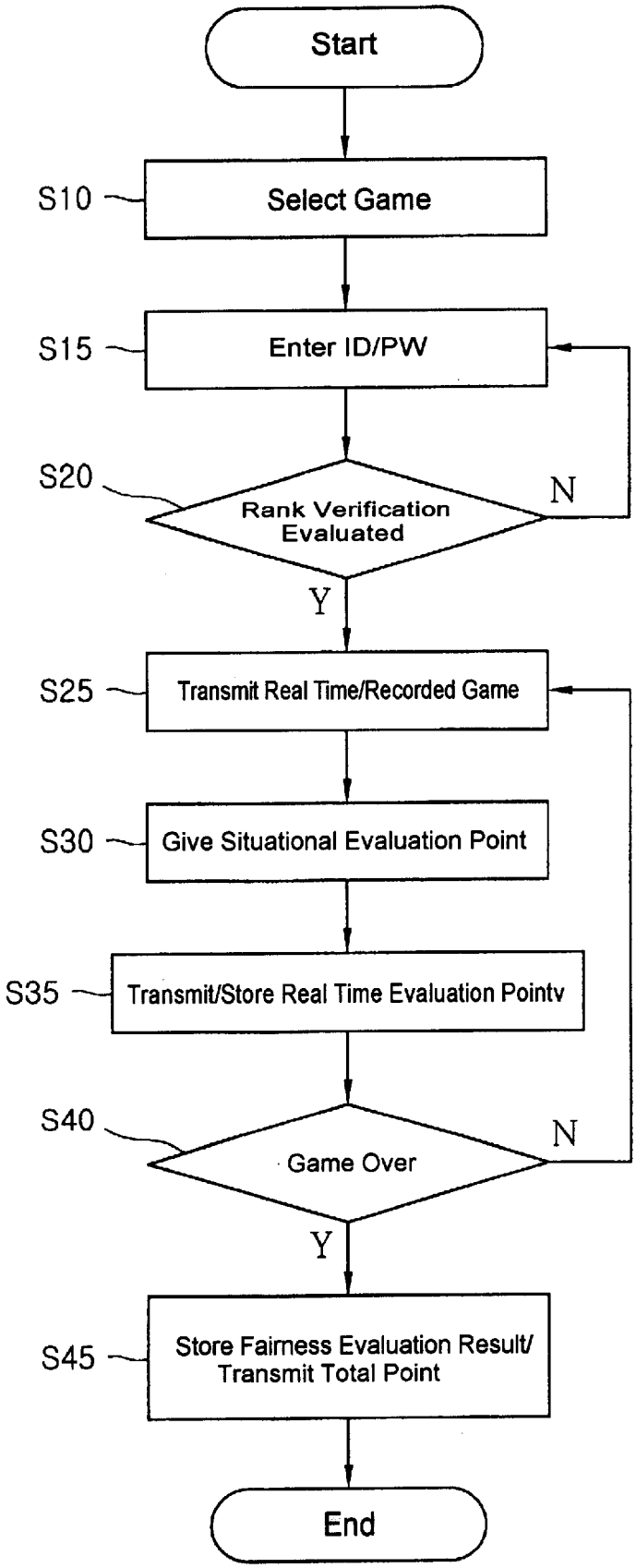
FIG. 2 is a flow chart of the fairness evaluation system about the judgment of referees and the management of coaching staffs in a sports game via internet according to the invention.

FIG. 2 is a flow chart of the fairness evaluation system about the judgment of referees and the management of coaching staffs in a sports game via internet according to the invention. The operation of the invention will be described in more detail in reference to FIG. 2.

First in the step of S10, each of the experts and the common internet users connected to the web server 300 of the invention selects a desired game through the computer or the terminal 100.

In the steps of S15 and S20, each of them enters an ID(Identification Data) and a PW(Pass Word) so that the web server 300 can judge the identity as an expert or a common internet user to give a verification according to evaluation rank.

Also, each of the certified experts and registered experts previously has an offline certification of the ID and the PW from a fairness evaluation committee, and each of the common internet users has a certification of the ID and the PW when obtaining a membership. In the time of the evaluation, the web server 300 inspects them to allocate grade rates according to evaluation rank so that they can be approved as the evaluators about the fairness.

In other words, the rank of the evaluators is determined according to a predetermined procedure so that a reliable judgment can be made about the fairness and the pertinency of the referees and the coaching staffs.

Then in the steps of S25 and S30, the game broadcasting through the broadcasting media 200 is transmitted in real time or as recorded through the web server, and the evaluators give evaluation points according to the previously provided evaluation forms according to situation while watching the transmitted game.

In the step of S35, the given points are temporarily stored in the web server 300 and transmitted to the evaluators and others connected to the web server according to situation and continuously accumulated until the game is over. In the step of S45, when the game is over, the web server 300 inspects the evaluation points to find an evaluation standard violation if any of the fairness evaluation standard database 700, and stores the fairness evaluation results as data about pertinent referee and coaching staff of the referee/coaching staff database 500. Then, the mean point about the evaluation results is obtained by totaling the evaluation points and is transmitted to the evaluators and others connected to the web server 30.

Figure 6:
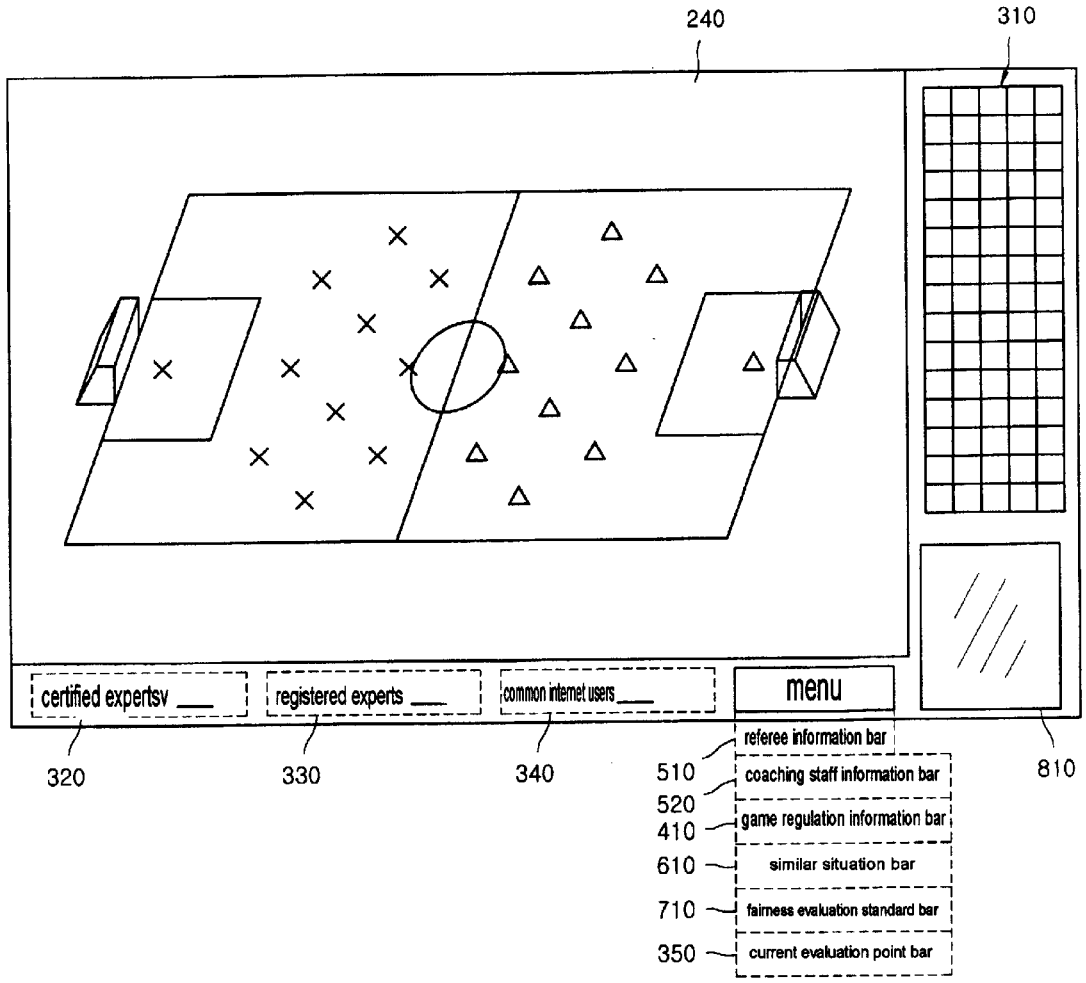
FIG. 6 is a structural view of a monitoring screen according to the embodiment of the invention.

FIG. 3 shows grades and distribution rates according to an embodiment of the invention, FIG. 4 shows details of the fairness evaluation standard about a referee according to the embodiment of the invention, FIG. 5 shows an example of a report sheet for the fairness evaluation of a soccer game according the embodiment of the invention, FIG. 6 is a structural view of a monitoring screen according to the embodiment of the invention, and FIG. 7 is an example of filling out the report sheet of FIG. 5 for the fairness evaluation of the soccer game according the embodiment of the invention.

As shown in FIG. 3, for a reliable and fair evaluation, the mean point distribution rank of the evaluators can be made variously. Preferably, the mean points of the certified experts are reflected 60%, the mean points of the registered experts are reflected 30%, and the mean points of the common internet users are reflected 10%.

Also, the evaluators can previously select evaluating subjects such as a referee, a subreferee, an A team coach and B team coach in order to enhance the efficiency of the evaluation.

The evaluators get familiar with the distribution about the evaluation standard as shown in FIG. 4 before distributing pertinent points. In other words, distribution is made about the referee including game operation, a communication with the subreferee, dignity, pertinency of the judgment such as closeness of a judging position, pertinency of a judging point, correctness of an expressing motion, correctness of the judgment and correctness of the judgment, and major foul judgments such as a partial judgment, pertinency of penalty kick and offside declarations and pertinency of the judgment at main areas.

FIG. 7 shows an example in which the evaluation form is actually filled out. FIG. 6 shows a screen structure displayed in the computer 100 in which a relay window 240 for relaying the game situation, an evaluation box 310 for entering about the evaluation form, an advertisement window 810 for displaying the advertisements during the game, and number boxes 320, 330 and 340 are provided. Each of the number boxes 320, 330 and 340 shows each of numbers of the certified experts, the registered experts and the common internet users to report the present condition of the evaluators thereby promoting a more objective evaluation.

If a menu button is clicked, a pull-down bar is generated. The pull-down bar includes a referee information bar 510 for showing information about the referee of the currently progressing game through the referee/coaching staff database 500, a coaching staff information bar 520, a game regulation information bar 410 for showing information about the regulation of the current game, a similar situation bar 610 for showing a similar situation about a specific situation, a fairness evaluation standard bar 710 which can be referred to for the fairness evaluation distribution, a current evaluation point bar 350 for showing the current total of evaluation points from the evaluators, etc. Therefore, the evaluators can monitor the general information and situation about the currently proceeding sports game to distribute points about the fairness and the pertinency of the referees and the coaching staffs so that a cheat such as a fabricated outcome can be prevented preliminarily.

Also, the advertisement window 810 displays the advertisements registered in the advertisement database 800 according to time, and also the screen window 240 temporarily displays the advertisements in an important moment to enhance the efficiency of the advertisements.

Also, it will be easy for those skilled in the art to establish a database for storing information about each of the players separately in the web server 300 so that records about the players and detailed information about teams can be referred to.

According to the invention described hereinbefore, the internet users can evaluate the fairness about the judgment of the referee while watching the game relayed through the internet thereby contributing to the development of the sports. Also, a motive is provided that the referees and the coaching staffs also can be immerged as star.

Also, the invention can monitor the referees by managing the judgments as points and database, protect the coaches at sites and the players who are endeavoring under the poor conditions from the one way partial judgments of the referees and protect childhood and teenagers sports from the fabricated outcomes if any. If the referees or the coaching staffs are found to be under the reference, a reeducation program can be presented or a qualification suspension can be recommended. When a referee made any intentional misjudgments and/or an excessive partial judgment or a coaching staff induced the same, they can be permanently expelled. Also, the most effective aspect is to eliminate any fabricated outcome and realize a healthy physical education in the childhood and teenagers sports field. Furthermore, the fairness can be evaluated about the old and habitual authoritative organization management and the continuous doubtful judgment of the sports field. Therefore, the participation of people to the sports can be enhanced, a healthy development of the sports can be promoted through reflecting the ideas of the people, and a living physical education can be promoted through a sports related sympathy.

What is claimed is:

1. A fairness evaluation system about the judgment of referees and the management of coaching staffs in a sports game via internet in a broadcasting system, comprising:

a broadcasting media 200 having a broadcasting station server 210 for converting and transmitting data so that a live or recorded relay of a game situation through a broadcasting camera 220 from a game site can be watched through communication media such as the internet;

a terminal 100 having a web browser for showing the images through said broadcasting media 200 on a monitor through the internet;

a web server 300 for transmitting the sports game sent from said broadcasting media 200 to each of said terminal 100 and for managing and receiving various information;

a game regulation database 400 connected to said web server 300 for storing each game regulation according to event as data;

a referee/coaching staff database 500 for storing personal information and history of referees and coaching staffs involved in the game as data;

a situational judgment standard database 600 for storing data or images of judgment in special or apparent referential situations from previous games;

a fairness evaluation reference database 700 for storing fairness evaluating references about the referees and the coaching staffs of the game through said terminal 100;

a search database 900 for providing real time information on the basis on true pictures and graphic data if internet users want to know applied regulations; and an advertisement database 800 for inserting advertisements during the game.

2. A fairness evaluation system about the judgment of referees and the management of coaching staffs in a sports game via internet according claim 1, wherein said terminal has:

a site terminal 110 of previously certified and registered experts for monitoring in the game site through said web server 300;

a registered terminal 120 of experts registered in said web server 300 for evaluating the fairness of the relayed images on a monitor through a computer in a location besides the game site; and an unregistered terminal 130 of the common internet users connected with said web server 300 for evaluating the fairness.

3. A fairness evaluation method about the judgment of referees and the management of coaching staffs in a sports game via internet in a broadcasting system, comprising the steps of:

connecting each of evaluators to a web server 300 of the internet and selecting a game according to event;

if an identification (ID) and a password (PW) of each of evaluators is entered, inspecting in the web server 300 if each of the evaluators is the certified expert or a registered expert who is previously set up in the web server or a common internet user and certifying the evaluators according to evaluation rank;

receiving in the web server 300 evaluation points through an evaluation form previously given according to situation while broadcasting game images through broadcasting media including the internet;

temporarily storing in the web server 300 the evaluation points and continuously accumulating until the game is over; and if the game is over, inspecting in the web server 300 if there is a violation against the evaluation standard of a fairness evaluation reference database 700, storing the evaluation points as data about pertinent person of the referee/coaching staff database 500, and then totaling the evaluation points to determine mean values used to convey evaluation results to the evaluators and others connected to the web server.

4. A fairness evaluation method about the judgment of referees and the management of coaching staffs in a sports game via internet according to claim 3, wherein said step of receiving in the web server 300 evaluation points comprises the step of real time transmitting the evaluation points to the evaluators according to situation while temporarily storing in the web server 300 the evaluation points.

5. A recording medium recording a computer-readable program in a broadcasting system for sports games via internet, the computer-readable program comprising the functions of:

converting data so that a live or recorded relay of a game situation through a broadcasting camera 220 from a game site can be watched through communication media such as the internet;

storing each game regulation according to event in a web server 300 connected to the internet as data;

storing personal information and history of referees and coaching staffs involved in the game as data;

storing data or images of judgment in special or apparent referential situations from previous games;

storing fairness evaluating references about the referees and the coaching staffs of the game through the terminal 100;

if internet users want to know applied regulations, providing real time information on the basis on true pictures and graphic data; and inserting advertisements during the game through the web server 300.

* * * * *